US007809287B2

(12) United States Patent
Okamura

(10) Patent No.: US 7,809,287 B2
(45) Date of Patent: Oct. 5, 2010

(54) CONSUMABLE CARTRIDGE AND IMAGE FORMING APPARATUS USING THE SAME

(75) Inventor: Takehiko Okamura, Matsumato (JP)

(73) Assignee: Seiko Epson Corporation, Tokyo (JP)

( * ) Notice: Subject to any disclaimer, the term of this patent is extended or adjusted under 35 U.S.C. 154(b) by 151 days.

(21) Appl. No.: 12/210,908

(22) Filed: Sep. 15, 2008

(65) Prior Publication Data

US 2009/0087198 A1 Apr. 2, 2009

(30) Foreign Application Priority Data

Sep. 27, 2007 (JP) ..... 2007-250603
Jul. 25, 2008 (JP) ..... 2008-191665

(51) Int. Cl.
*G03G 15/00* (2006.01)

(52) U.S. Cl. ..... 399/12; 399/111

(58) Field of Classification Search ..... 399/9, 399/12, 24, 25, 107, 110, 111; 347/19
See application file for complete search history.

(56) References Cited

U.S. PATENT DOCUMENTS 6,895,191 B2 * 5/2005 Rommelmann et al. ..... 399/12
6,912,365 B2 * 6/2005 Ueno et al. ..... 399/25
7,370,930 B2 * 5/2008 Kosugi ..... 347/19
7,505,698 B2 * 3/2009 Morimoto ..... 399/12
2007/0071458 A1 3/2007 Tanaka et al.

FOREIGN PATENT DOCUMENTS

JP 2001-105625 4/2001
JP 2003039783 A 2/2003
JP 2003-195698 7/2003
JP 2006215441 A 8/2006
JP 2007122011 A 5/2007

* cited by examiner

*Primary Examiner*—Hoan Tran
(74) *Attorney, Agent, or Firm*—Hogan Lovells US LLP

(57) ABSTRACT

Both the user of an image forming apparatus and the image forming apparatus can determine if the consumable cartridge supplied to the apparatus is a refilled product or not at a glance. The consumable cartridge is for supplying a consumable to be used in the image forming process of an image forming apparatus to the image forming apparatus. It has an ID tag memory seal 100 arranged at a predetermined position and includes an ID tag memory electrically indicating that the consumable cartridge is supplied by the manufacturer of the image forming apparatus and a logo label section, arranged on the surface of the ID tag memory for causing the user to visually recognize that the consumable cartridge is supplied by the manufacturer of the image forming apparatus.

9 Claims, 15 Drawing Sheets

CONSUMABLE CARTRIDGE AND IMAGE FORMING APPARATUS USING THE SAME

CROSS-REFERENCE TO RELATED APPLICATION

This application is based upon and claims the benefit of priority from the prior Japanese Patent Applications Nos. 2007-250603, filed on Sep. 27, 2007, and 2008-191665, filed on Jul. 25, 2008, the entire contents of which are incorporated herein by reference.

BACKGROUND OF THE INVENTION

1. Field of the Invention

The present invention relates to a removable and consumable cartridge suited for use in an image forming apparatus. More particularly, it relates to a consumable cartridge of which the user can identify the provider at the time of loading it in an image forming apparatus to tell with ease if it is provided by the manufacturer of the image forming apparatus or some other provider. The present invention also relates to an image forming apparatus adapted to notify the user of the fact that a consumable cartridge provided by a provider other than the manufacturer of the apparatus is loaded therein if such is the case.

2. Description of the Related Art

Image forming apparatus including electrophotographic copying machines, electrophotographic printers, electrophotographic facsimile machines, electrophotographic multifunction devices, ink-jet printers and ink-jet multifunction devices are provided with cartridges filled with respective consumables such as toner and ink and as the toner or the ink is totally consumed, the corresponding consumable cartridge is replaced by a new one. In this way, consumables are supplied to the image forming apparatus.

There has been in recent years and still is a trend that third parties (third vendors) other than the manufacturer of an image forming apparatus manufacture and sell consumable cartridges that can be loaded in the image forming apparatus. However, those consumables supplied by third vendors other than the manufacturer of the image forming apparatus can include those that do not match the image forming process of the image forming apparatus. Therefore, techniques of detecting consumable cartridges other than those supplied by the manufacturer and issuing a predetermined warning have been proposed to cope with such a situation.

For example, JP 2003-195698-A (Patent Document 1) describes an image forming apparatus having an image forming section including a removable process unit and a scanner for scanning an original, characterized by also having a control section for causing the scanner to read out the image on the sheet annexed to the process unit and determining if the process unit is a genuine product or not on the basis of the read out image data.

SUMMARY OF THE INVENTION

Meanwhile, the consumable cartridges supplied by third vendors include those originally supplied by the manufacturer of an image forming apparatus but refilled with toner or ink conforming to the unique specification of a third vendor (to be also referred to as "cartridge regenerator" hereinafter) after use. Such consumable cartridges refilled by cartridge regenerators (to be also referred to as "refilled cartridges" hereinafter) can sometimes hardly be discriminated from consumable cartridges provided by the manufacturer of the image forming apparatus by appearance to give rise to a problem.

However, an image forming apparatus described in the above-cited Patent Document 1 is designed to read out the image on the sheet annexed to the loaded process unit and determine if the protection is a genuine product or not on the basis of the read out image data so that it is accompanied by a problem that it determines a refilled consumable cartridge to be a genuine cartridge provided by the manufacturer of the image forming apparatus.

In view of the above-identified problem, according to the present invention, there is provided a consumable cartridge for supplying a consumable to be used in the image forming process of an image forming apparatus to the image forming apparatus, the consumable cartridge having a memory identification section arranged at a predetermined position and including a memory electrically indicating that the consumable cartridge is supplied by the manufacturer of the image forming apparatus and a label section arranged on the surface of the memory; the memory identification section being so arranged as to be movable from the predetermined position to become unreadable to the memory reader section of the image forming apparatus when the image forming apparatus acknowledges a request for removing the consumable cartridge.

Preferably, in a consumable cartridge according to the present invention, the label section is a logo label section for causing the user to visually recognize that the consumable cartridge is supplied by the manufacturer of the image forming apparatus.

Preferably, in a consumable cartridge according to the present invention, the memory identification section is so arranged as to be interlocked with the consumable cartridge being removed from the image forming apparatus and become movable.

Preferably, in a consumable cartridge according to the present invention, the memory identification section is a plate that can slide.

Preferably, in a consumable cartridge according to the present invention, the memory identification section is a film that can be taken up.

Preferably, in a consumable cartridge according to the present invention, the memory identification section is arranged on the cap section for sealing the consumable filling mouth of the consumable cartridge to be used when the consumable cartridge is filled with a consumable.

In another aspect of the present invention, there is provided an image forming apparatus to be loaded with a consumable cartridge having an memory identification section arranged at a predetermined position and including a memory electrically indicating that the consumable cartridge is supplied by the manufacturer of the image forming apparatus and a label section arranged on the surface of the memory; the image forming apparatus having a tag memory reader/writer section for reading the information stored and/or writing the information on the memory, a removal request determining section for determining if a request for removing the consumable cartridge is made or not and a drive mechanism for driving the memory identification section to move when it is determined that a request for removing the consumable cartridge is made.

Preferably, in an image forming apparatus according to the present invention, the tag memory reader/writer section rewrites the information stored in the memory when the removable request determining section determines that a request for removing the consumable cartridge is made.

In another aspect of the present invention, there is provided an image forming apparatus to be loaded with a consumable cartridge having a memory identification section arranged at a predetermined position and including a memory electrically indicating that the consumable cartridge is supplied by the manufacturer of the image forming apparatus and a label section arranged on the surface of the memory; the image forming apparatus having a tag memory reader/writer section for reading the information stored and/or writing the information on the memory and a drive mechanism for interlocking the consumable cartridge being removed from the image forming apparatus with and driving the memory identification section to move.

Thus, with a consumable cartridge according to the present invention, the memory identification section including a memory electrically indicating that the consumable cartridge is supplied by the manufacturer of the image forming apparatus and a logo label section arranged on the surface of the memory is moved without fail after the first use of the consumable cartridge so that the user can determine at a glance if the consumable cartridge is a refilled product or not by checking the status of the memory identification section and, at the same time, the image forming apparatus can electrically determine if the consumable cartridge is a refilled product or not. Additionally, the memory identification section is arranged so as to become movable and make the memory reader section of the image forming apparatus no longer able to read the so that the memory of a refilled product refilled with toner and sold after use cannot be read out to eliminate the risk that a refilled consumable cartridge is determined as genuine cartridge.

When a consumable cartridge is loaded into an image forming apparatus according to the present invention, since the image forming apparatus is provided with a tag memory reader/writer section for reading the information stored and/or writing the information on the ID tag memory, warning can be displayed to the user when the consumable cartridge is a refilled product. Then, the manufacturer of the image forming apparatus can make the user realize that the consumable cartridge is a refilled product and the user should use the consumable cartridge, knowing that it involves the risk that inevitably arises when using a refilled product.

DETAILED DESCRIPTION OF THE PREFERRED EMBODIMENTS

Figure 1:
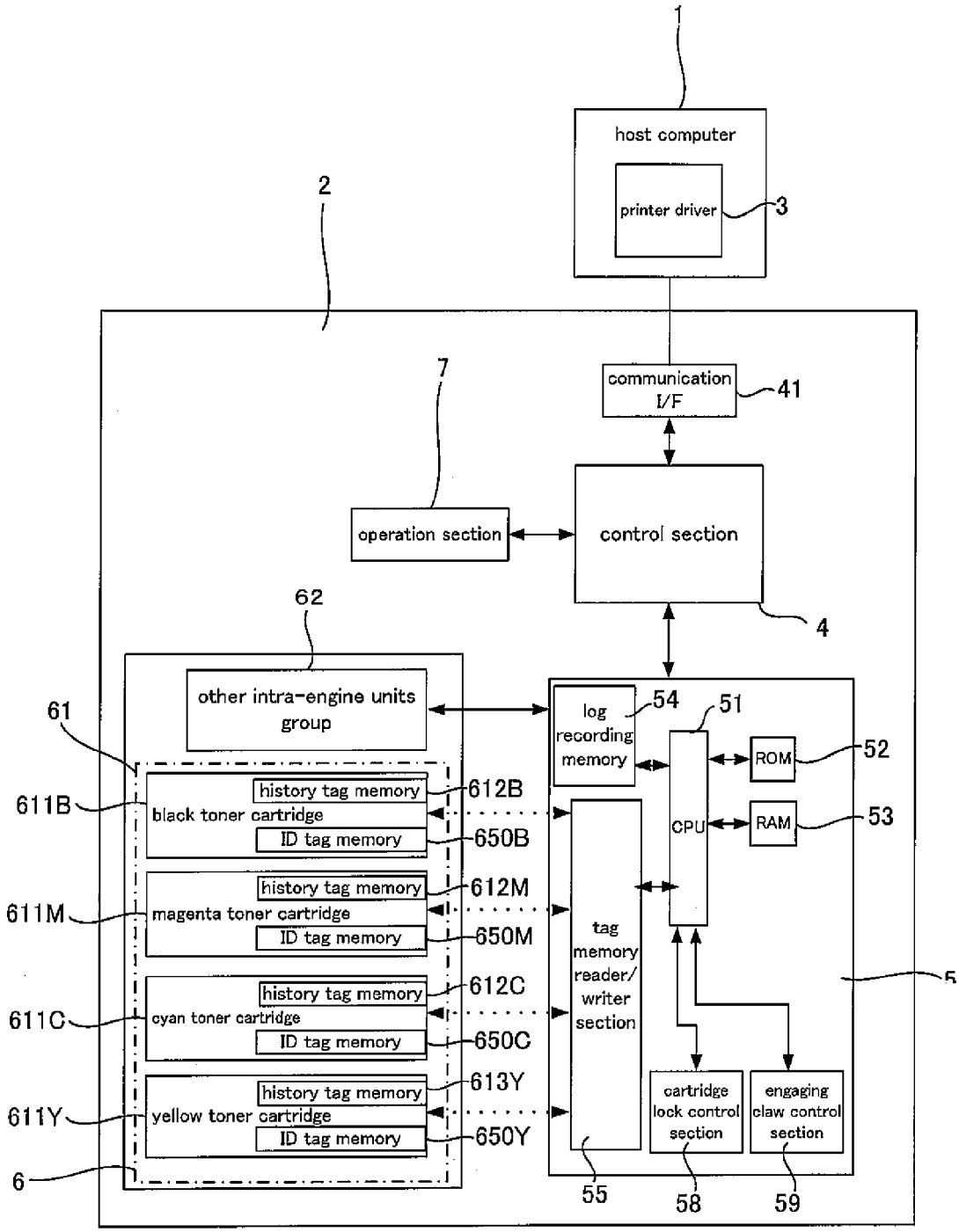
FIG. 1 is a schematic block diagram of an embodiment of image forming apparatus according to the present invention, which is a printer.

Now, the first embodiment of image forming apparatus according to the present invention, which is a printer, will be described below by referring to the related drawings. FIG. 1 is a schematic block diagram of an embodiment of image forming apparatus according to the present invention, which is a printer. The printer 2 shown in FIG. 1 is realized by applying the present invention and designed to form an image on a predetermined printing medium according to a printing request from a host computer 1 (host apparatus). The printer 2 is adapted to be loaded with toner cartridges 611 (development units) of four colors of yellow, cyan, magenta and black in order to form an image by selectively using different toners and sequentially laying toner images of the different colors according to a printing request. Some of the reference numerals in the drawings may specifically be suffixed by Y, C, M or B, which stand for yellow, cyan, magenta and black respectively, whenever appropriate. On the other hand, the suffixes of Y, C, M and B may be omitted for such arrangements that are common to all the colors of yellow, cyan, magenta and black.

The host computer 1 shown in FIG. 1 is a host apparatus that issues a printing request to the printer 2 by way of communication I/F 41 of the printer 2. It transmits printing data including image data and control commands to the printer 2 according to user operations. Note that the host computer 1 may be formed by a so-called personal computer. While the printer 2 is connected to the host computer 1 in FIG. 1, it may alternatively be connected to a plurality of host apparatus by way of a network. For this purpose, a known interface means conforming to established standards such as a 100BASE-TX/10BASE-T Multi Protocol Ethernet (trademark) interface or a HI-SPEED USE (USB 2.0) interface may be used for the communication I/F 41. Printer drive 3 in the host computer 1 is a part that receives data from an application (not shown) in the host computer 1 and generates the printing data to be transmitted to the printer 2.

As shown in FIG. 1, the printer 2 typically includes a control section 4, an engine control section 5, an engine 6 and an operation section 7. The control section 4 receives the printing data transmitted from the host computer 1 and interprets the control commands included in the data. It also executes predetermined processes on the image data included in the data and generates the data to be provided to the engine 6. Although not shown, the control section 4 includes a CPU and an image memory, which image memory stores the generated data. The control section 4 transmits information to the engine control section 5, telling it to start a printing operation, when a predetermined quantity of data is generated and stored in the image memory.

Referring also to FIG. 1, the engine control section 5 typically includes a CPU 51, a ROM 52, a RAM 53, a log recording memory 54, a tag memory reader/writer 55, a cartridge lock control section 58 and a logo label control section 59. The CPU 51 is a part that controls the components of the engine 6. The CPU 51 also reads information from the history tag memory 612 and the ID tag memory 650 arranged in each toner cartridge 611 by way of the tag memory reader/writer section 55 and executes processes and makes determinations according to the information. The tag memory reader/writer section 55 is adapted to write necessary information on the history tag memory 612 and the ID tag memory 650 including information to be written one time. While it is assumed in this embodiment that information is written to and read out from the tag memories including the history tag memory 612 and the ID tag memory 659 by way of a non-contact type communication system, employing RFID, the present invention is by no means limited to a non-contact type communication system and a contact type communication system using terminals may alternatively be used for the purpose of the present invention.

The ID tag memory 650 at least electrically indicates that the toner cartridge 611 is supplied by the manufacturer of the printer 2.

The history tag memory 612 is dedicated exclusively to management of information on the remaining quantity of toner and the profile of the toner cartridge to which it is mounted.

The log recording memory 54 is a non-volatile memory of a known type for recording information on the toner cartridges 611 that have been loaded in the printer 2 on the main body of the printer 2 according to the management information stored in the history tag memory 612.

The ID tag memory 650 is arranged separately from the history tag memory 612. It is a memory for storing the ID specific to the manufacturer of the image forming apparatus and may typically operate for RFID.

The ROM 52 stores various programs for controlling the printer 2 and the RAM 53 temporarily stores various pieces of information relating to the printer 2. The tag memory reader/writer section 55 is an interface between the CPU 51 and the history tag memory 612 and the ID tag memory 650 at the side of the toner cartridge. It is operated when the CPU 51 reads out the information written in the toner cartridge side memory 612 and writes in the log recording memory 54.

The cartridge lock control section 58 controls the lock mechanism of each of the loaded toner cartridges 611. The logo label control section 59 controls the up and down motions of the engaging claw of each toner cartridge 611 as will be described in greater detail hereinafter.

Figure 2:
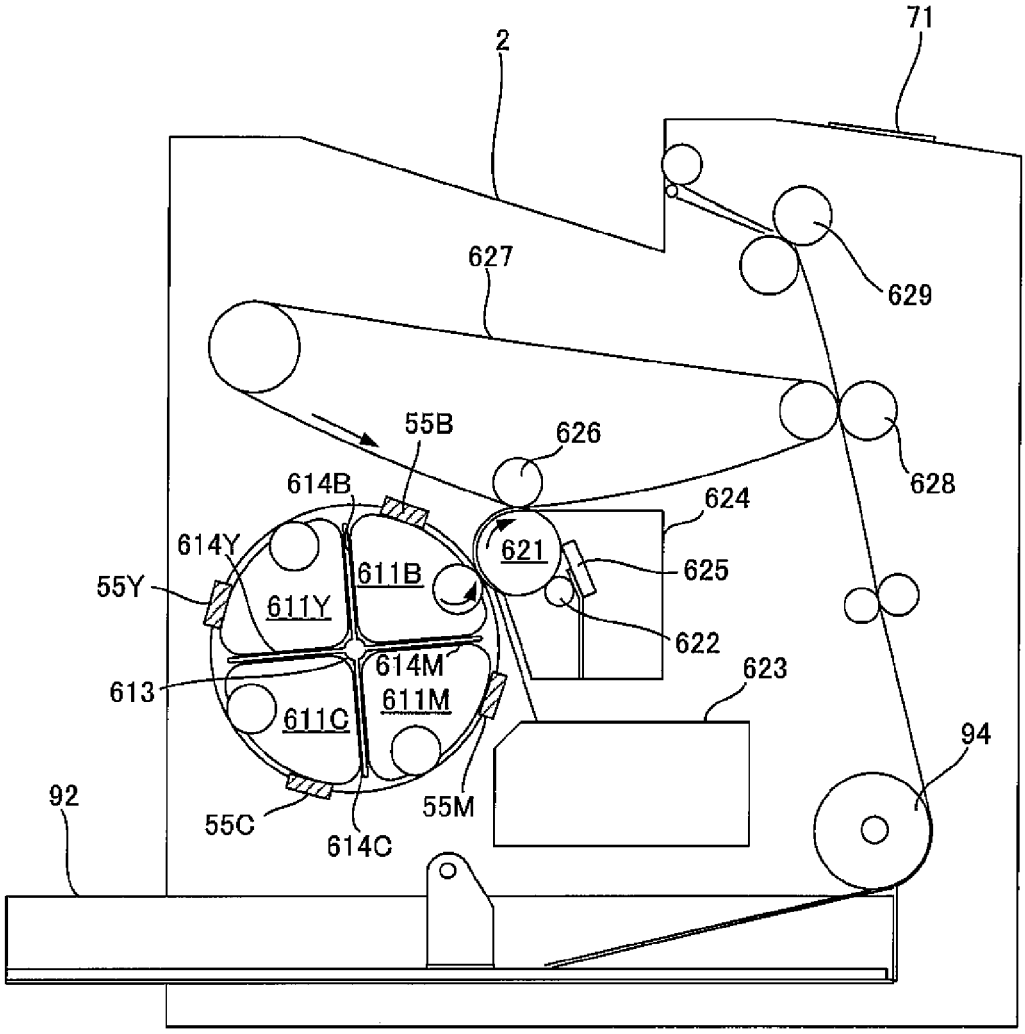
FIG. 2 is a schematic cross-sectional view of a principal part centered at the engine 6 of the printer 2 of the embodiment of FIG. 1.

FIG. 2 is a schematic cross-sectional view of a principal part centered at the engine 6 of the printer 2 of this embodiment.

Referring to FIG. 2, photosensitive drum 621 includes a cylindrical and conductive base material and a photosensitive layer formed around the other peripheral surface of the member and can be driven to rotate clockwise around its center axis as indicated by an arrow in FIG. 2. Charging unit 622 charges the photosensitive drum 621 with electricity and exposure unit 623 irradiates the beam from a laser or an LED array contained in it on the electrically charged photosensitive drum 621 to form an electrostatic latent image on the photosensitive drum 621. The beam irradiation of the exposure unit 623 is controlled by a drive signal that is modulated according to the image information input from the host computer 1.

Development unit 61 is a development rotary that can rotate around center axis 613 and includes loading sections 614B through 614Y where a black toner cartridge 611B, a magenta toner cartridge 611M, a cyan toner cartridge 611C and a yellow toner cartridge 611Y containing toner as a developer are respectively removably loaded. The latent image is developed by a developer as the development unit 61 is driven to rotate and the cartridge that needs to be operated is selected from the toner cartridges 611B through 611Y and driven to move close to the photosensitive drum 621 and feed the latent image carrying photosensitive drum 621 with the developer.

The toner cartridges 611 are provided with respective memory mediums for storing color information and information on the remaining quantities of the developers (toners), or history tag memories 612B through 612Y that are typically non-contact type nonvolatile memories.

After the power source of the printer 2 is turned on or a toner cartridge 611 is loaded into the development unit 61 of the printer 2, the information stored in the history tag memory 612 is read out by the printer 2. After a development process, the information on the remaining quantity of the developer in each of the toner cartridges 611 is updated. Each of the toner cartridge side memories 612 may store information on the type of the toner contained in the toner cartridge 611 and other various pieces of information. The history tag memory reader/writer section 55 of the engine control section 5 and the history tag memories 612B through 612Y may communicate with each other in a non-contact manner, or by means of radio frequency waves, or alternatively, the history tag memory reader/writer section 55 of the engine control section 5 and the history tag memories 612B through 612Y may communicate with each other by way of wires.

The toner cartridges 611 are also provided with respective ID tag memories 650B through 650Y in addition to the history tag memories 612B through 612Y as separate tag memories. Each of the ID tag memories 650B through 650Y stores information indicating that the toner cartridge 611 is not a refilled product provided by a cartridge regenerator but a genuine product provided by the manufacturer of the printer 2 which may typically include ID specific to the manufacturer. Each of the ID tag memories 650B through 650Y may be so arranged that the specific ID information stored there is erased after the use of the toner cartridge 611. When the specific ID information is to be erased, the ID tag memory 650 may preferably be of a one-time writable type memory.

A particular protocol and/or a cryptogram that only the manufacturer knows may be used when reading and writing data in the ID tag memories 650.

Referring to FIG. 2, primary transfer unit 626 transfers a toner image formed on the photosensitive body 621 onto intermediate transfer member 627. The intermediate transfer member 627 is typically an endless belt prepared by forming an aluminum vapor deposition layer on the surface of a belt of PET film and applying a paint of semiconductor onto the surface of the aluminum vapor deposition layer. It is driven to move round at a speed same as the speed of rotation of the outer periphery of the photosensitive drum 621. The printing medium fed from a sheet feed cartridge 92 is conveyed to the secondary transfer unit 628 and then to fixing unit 629 by way of a sheet feed roller 94. Then, the secondary transfer unit 628 transfers the toner image formed on the intermediate transfer member 627 onto the printing medium fed from the sheet feed cartridge 92 and the fixing unit 629 deposits the toner image transferred onto the printing medium to turn it into a permanent image. The printing medium is then delivered to the outside of the printer 2.

Cleaning unit 624 is arranged between the primary transfer unit 626 and the charging unit 622 and includes a cleaning blade to be brought into contact with the surface of the positive drum 621. Thus, the developer (toner) remaining on the photosensitive drum 621 after the primary transfer is removed by the cleaning blade 625.

The operation section 7 (operation means) shown in FIG. 1 is a part byway of which the user operates the printer 2 and includes an operation display panel 71 and operation buttons. A touch panel and other devices are arranged on the operation display panel 71. The user can operate the printer 2 by directly touching the operation display panel 71, referring to the UI (user interface) displayed on the operation display panel 71. The user can do various setting operations on the operation section 7 for selecting and setting the printing conditions of the printer 2. When any of the toner cartridges 611 is to be removed from the printer 2, the operation display panel 71 is operated to issue commands for the toner cartridge unloading operation.

Figure 3:
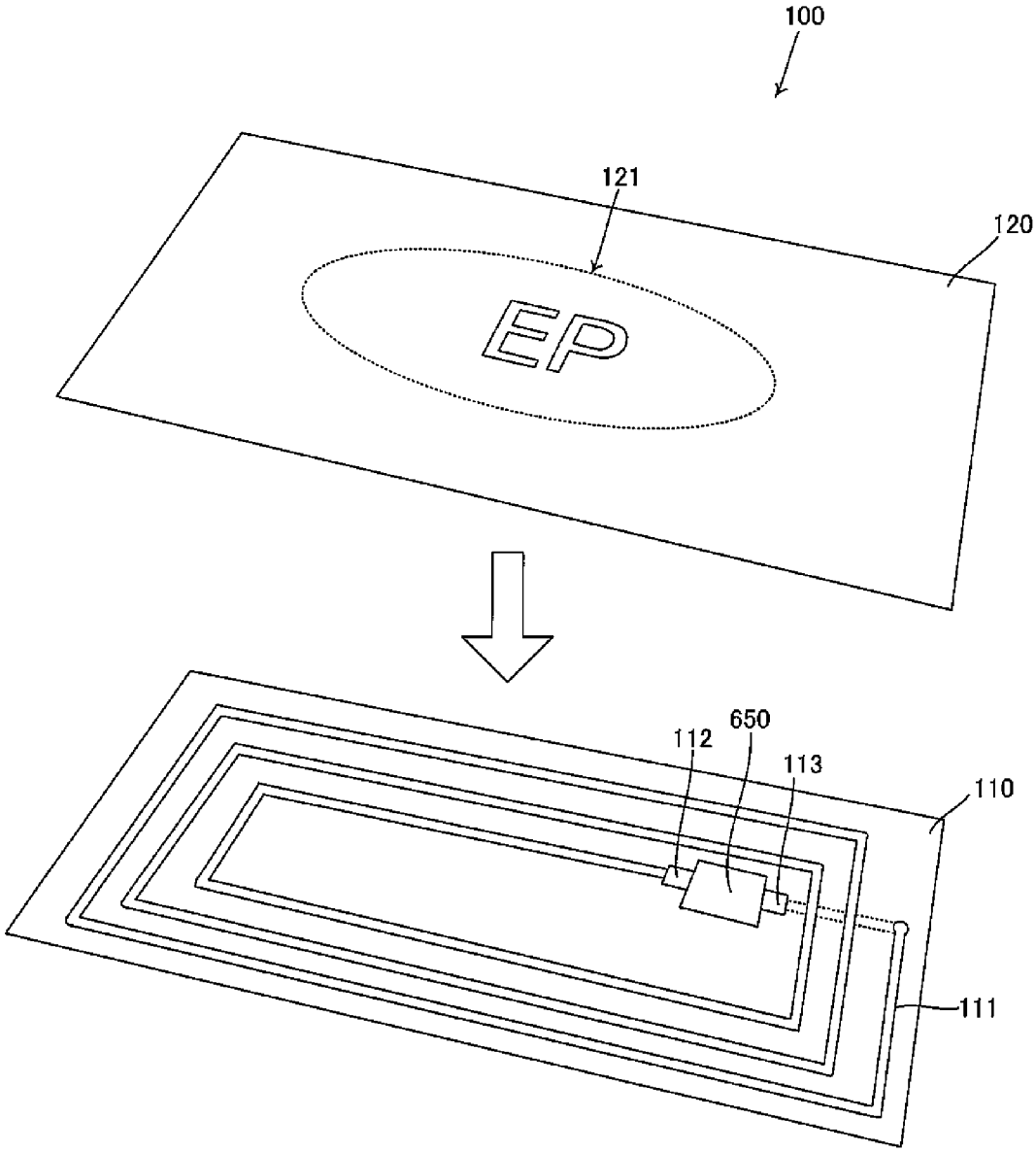
FIG. 3 is a schematic perspective view of an ID tag memory seal that can be used for an embodiment of consumable cartridge according to the present invention, which is a toner cartridge, showing the structure thereof.

Now, the ID tag memory to be used in a toner cartridge of this embodiment will be described in detail below. FIG. 3 is a schematic perspective view of an ID tag memory seal that can be used for a toner cartridge, showing the structure thereof.

Referring to FIG. 3, 100 generally denotes an ID tag memory seal and 110 and 111 respectively denote a base film and an antenna section, while 112 and 113 denote electrode sections and 120, 121 and 650 respectively denote a hologram section, a logo label section and an RFID chip (ID tag memory main body).

The antenna section 111 is formed by etching the copper deposited on the front surface of the base film 110 of the ID tag memory seal 100 (the surface shown in FIG. 3). One of the opposite ends of the antenna section 111 is electrically connected to the electrode section 112 of an aluminum plate on the front surface side of the base film 110. The other end of the antenna section 111 is made to extend on the rear surface of the base film 110 by way of a through hole and electrically connected to the electrode section 113 of an aluminum plate. The electrode sections 112, 113 of aluminum plates are bonded to the RFID chip (ID tag memory) 650 by vibration welding.

A film which typically constitutes the logo label section 120 is unseparably attached to the front surface of the base film 110 having the above-described configuration by means of adhesive. A logo label 121 of the manufacturer firm of the printer 2 is printed on the logo label section 120 to form a visual display that can appeal the user of the printer 2. A hologram seal may be used for the logo label section 120.

Note that the ID tag memory seal 100 where the logo label section 120 is attached to the base film 110 is expressed as "tag memory section" in the appended claims.

An adhesive layer is formed on the rear surface of the base film 110 so as to make the ID tag memory seal 100 attachable to it. The ID tag memory seal 100 is attached to the toner cartridge 611 by means of the adhesive layer formed on the rear surface of the base film 110.

Figure 4A:
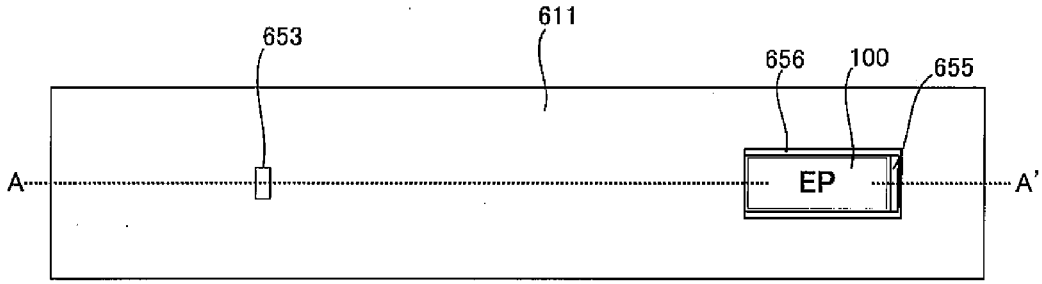
FIG. 4A is a schematic top view of the toner cartridge of the embodiment of FIG. 3.
Figure 4B:
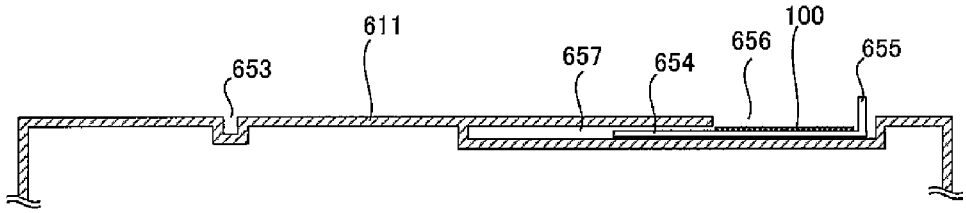
FIG. 4B is a part of a schematic cross-sectional view of the toner cartridge of the embodiment of FIG. 3 taken along line A-A' in FIG. 4A.

Now, the configuration of a toner cartridge will be described below. FIGS. 4A and 4B schematically illustrate a toner cartridge of this embodiment of the present invention. FIG. 4A is a schematic top view of the toner cartridge and FIG. 4B is a part of a schematic cross-sectional view of the toner cartridge 3 taken along line A-A' in FIG. 4A.

In FIGS. 4A and 4B, 653 denotes a lock claw engaging recess and 654 denotes a logo label plate, while 655 denotes a plate perpendicular piece and 656 and 657 respectively denote a label exposing aperture section and a plate containing section.

As shown in FIGS. 4A and 4B, the front surface of the toner cartridge 611 is provided with a lock claw engaging recess 653 to be engaged with a lock claw that is controlled by the cartridge control section 58.

Additionally, the front surface of the toner cartridge 611 is provided with a label exposing aperture section 656 and a hollow section of the plate containing section 657 is arranged in communication with the label exposing aperture section 656. The logo label plate 654 is transversally movably contained in the plate containing section 657.

The logo label plate 654 is provided with a surface region where the ID tag memory seal 100 is attached and the plate perpendicular piece 655 that is a projecting piece projecting perpendicularly relative to the surface region. As the plate perpendicular piece 655 is moved in the leftward direction in FIGS. 4A and 4B, the ID tag memory seal 100 attached to the logo label plate 654 is moved from the label exposing aperture section 656 into the plate containing section 657 until the user can no longer see the logo label 121 of the ID tag memory seal 100.

Figure 5A:
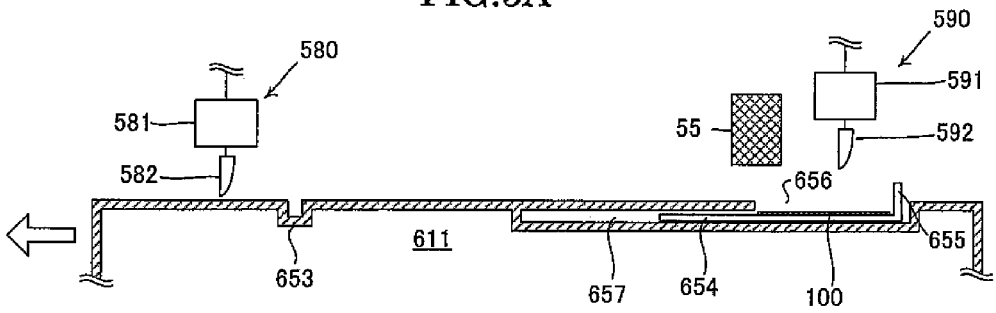
FIG. 5A is a schematic illustration of the toner cartridge of the embodiment of FIG. 3, showing how it appears immediately before being set in the loading position thereof.
Figure 5B:
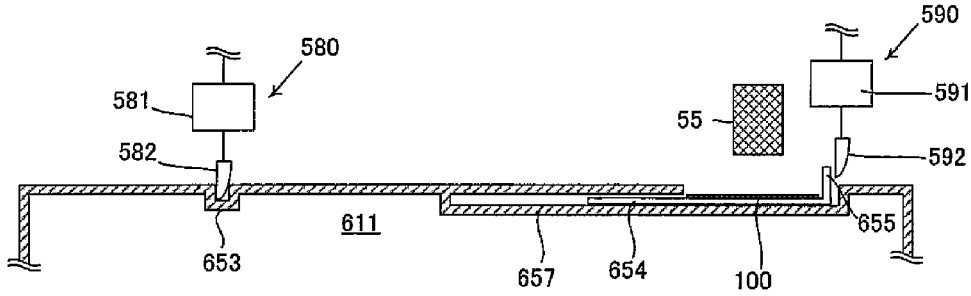
FIG. 5B is a schematic illustration of the toner cartridge of the embodiment of FIG. 3, showing how it appears when set in the loading position thereof.
Figure 5C:
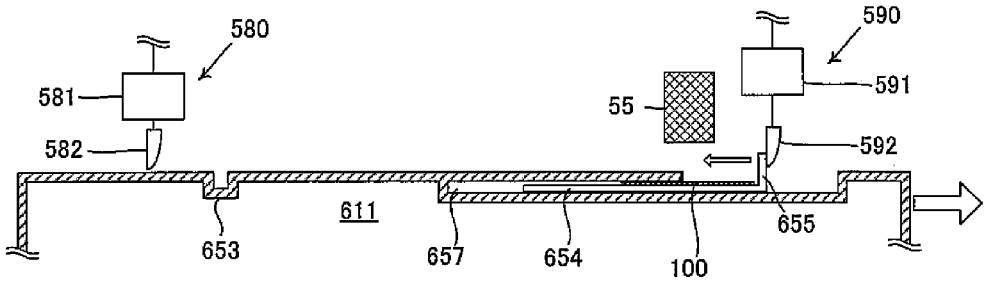
FIG. 5C is a schematic illustration of the toner cartridge of the embodiment of FIG. 3, showing how it appears when being unloaded for replacement.

Now, the operation of loading the toner cartridge 611 having the above-described configuration into the printer 2 will be described below. FIGS. 5A through 5C schematically illustrate how a toner cartridge of this embodiment is loaded in the printer. FIG. 5A is a schematic illustration of the toner cartridge that shows how it appears immediately before being set in the loading position thereof. FIG. 5B is a schematic illustration of the toner cartridge that shows how it appears when set in the loading position thereof. FIG. 5C is a schematic illustration of the toner cartridge that shows how it appears when being unloaded for replacement. Assume here that the toner cartridge 611 is pushed from right to left for a loading operation and drawn out from left to right for an unloading operation in FIGS. 5A through 5C.

Referring to FIGS. 5A through 5C, 580 denotes a cartridge lock control mechanism section and 581 denotes a lock claw drive mechanism section, whereas 590 denotes a logo label control mechanism section 590 and 591 and 592 respectively denote an engaging claw drive mechanism section and an engaging claw.

The tag memory reader/writer section 55, the cartridge lock control mechanism section 580 and the logo label control mechanism section 590 all belong to the printer 2. The cartridge lock control mechanism section 580 and the logo label control mechanism section 590 are controlled respectively by the cartridge lock control section 58 and the logo label control section 59. Note that the tag memory reader/writer section 55 in FIGS. 5A through 5C is that of the ID tag memory 650 and that of the history tag memory 612 is not shown in FIGS. 5A through 5C.

The cartridge lock control mechanism section 580 includes the lock claw 582 that can be inserted into the lock claw engaging recess 653 and the lock claw drive mechanism section 581, which may typically be an actuator for driving the lock claw 582 to move up and down, while the logo label control mechanism section 590 includes the engaging claw 592 that can be engaged with the plate perpendicular piece 655 and the engaging claw drive mechanism section 591, which may typically be an actuator for driving the engaging claw 592 to move up and down.

The lock claw 582 can take either of two positions including a raised position and a lowered position as it is driven to operate by the lock claw drive mechanism section 581. Similarly, the engaging claw 592 can take either of two positions including a raised position and a lowered position as it is driven to operate by the engaging claw drive mechanism section 591.

FIG. 5A schematically illustrates the toner cartridge 611, showing how it appears immediately before being set in the loading position thereof. At this time, the lock claw 582 and the engaging claw 592 are driven to take the respective raised positions by the lock claw drive mechanism section 581 and the engaging claw drive mechanism section 591. With this arrangement, the user can set the toner cartridge 611 in the cartridge loading position of the printer 2 without receiving any resistance.

FIG. 5B also schematically illustrates the toner cartridge 611, showing how it appears when set in the loading position thereof. At this time, the lock claw 582 and the engaging claw 592 are driven to take the respective lowered positions by the lock claw drive mechanism section 581 and the engaging claw drive mechanism section 591. Since the lock claw 582 is inserted into the lock claw engaging recess 653 under this condition, the toner cartridge 611 cannot be drawn out from the cartridge loading position of the printer 2. Additionally, under the condition of FIG. 5B, the tag memory reader/writer section 55 that is located on the top surface of the ID tag memory seal 100 that is attached to the logo label plate 654 can read information from and write information on the ID tag memory 650.

FIG. 5C also schematically illustrates the toner cartridge 611, showing how it appears when being unloaded for replacement. In other words, FIG. 5C schematically illustrates the toner cartridge 611 immediately after being taken out from the loading position. At this time, the lock claw 582 and the engaging claw 592 are driven to take the respective raised positions by the lock claw drive mechanism section 581 and the engaging claw drive mechanism section 591. With this arrangement, the user can take out the toner cartridge 611 because the lock claw 582 is disengaged from the lock claw engaging recess 653. Additionally, since the plate perpendicular piece 655 is engaged with the engaging claw 592, the logo label plate 654 can be driven to move leftward in FIGS. 5A through 5C and the ID tag memory seal 100 attached to the logo label plate 654 can be driven to move into the plate containing section 657 from the label exposing aperture section 656 to make the logo label 121 of the ID tag memory seal 100 invisible to the user. With this move, the ID tag memory 650 of the ID tag memory seal 100 is shifted away from the reading position of the tag memory reader/writer section 55. As a result, if the toner cartridge 611 is loaded once again in the printer 2, the printer 2 can no longer electrically recognize the ID tag memory 650. Additionally, the label exposing aperture section 657 may preferably be provided on the inner surface thereof with an aluminum layer to shield the ID tag memory 650 to make the tag memory reader/writer section 55 unable to recognize the ID tag memory 650.

With the above-described arrangement, the ID tag memory seal 100 attached to the logo label plate 654 is moved after the first use of the toner cartridge 611 without fail so that the user can see the status of the ID tag memory seal 100 and clearly realize if the toner cartridge is a refilled product or not at a glance and, at the same time, the printer 2 can electrically determine if the consumable cartridge is a refilled product or not.

Figure 6:
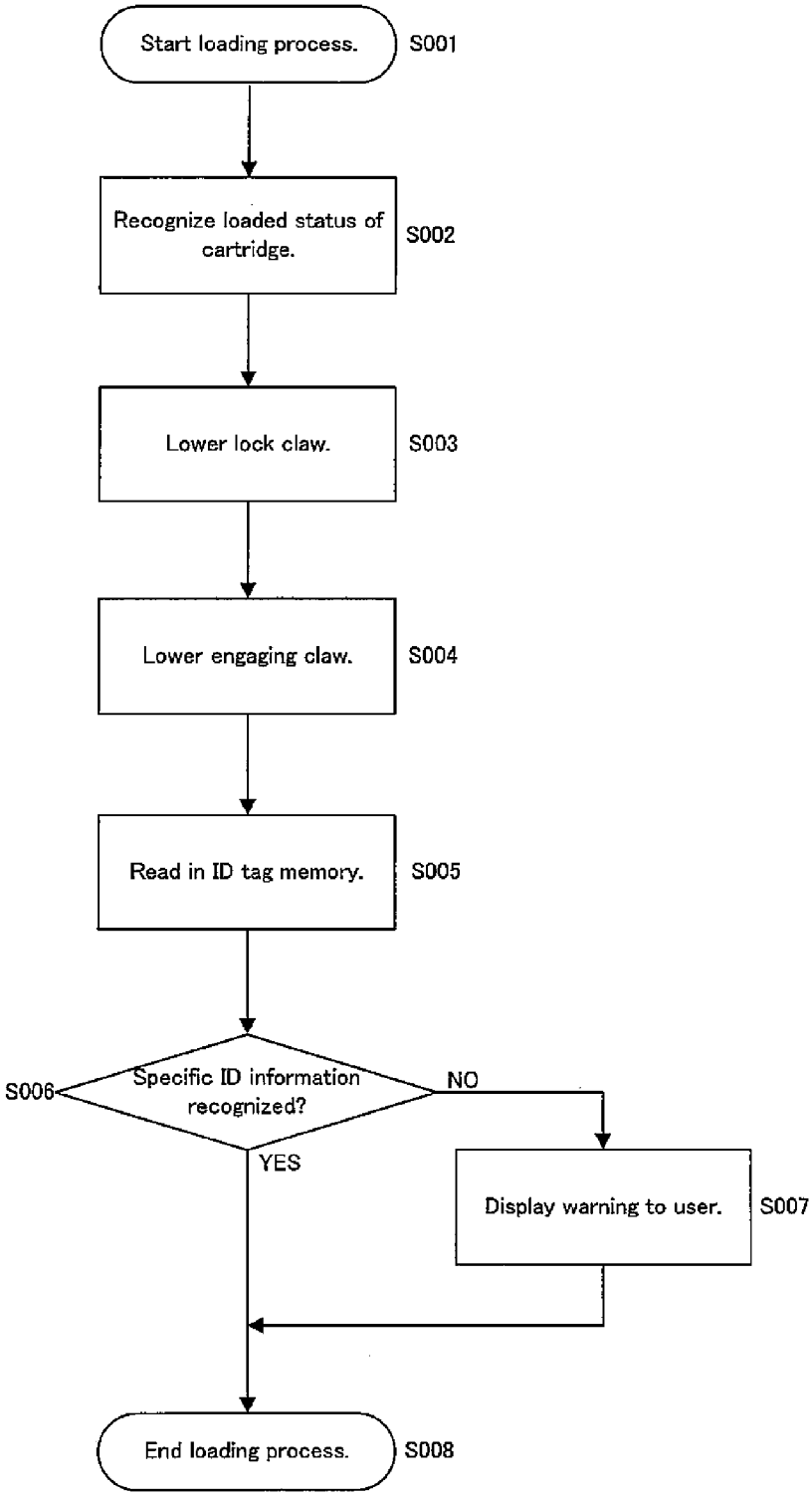
FIG. 6 is a flowchart of the process of loading a toner cartridge of the embodiment of FIG. 3.

Now, how the process of loading a toner cartridge 611 and that of unloading a toner cartridge 611 are controlled will be described below. FIG. 6 is a flowchart of the process of loading a toner cartridge of this embodiment of the present invention.

Firstly, in Step S001, the process of loading a toner cartridge 611 is started. Then, the process proceeds to Step S002, where a sensor (not shown) for sensing the completion of a loading process recognizes the loaded status of the toner cartridge 611. Then, in Step S003, the lock claw drive mechanism section 581 drives the lock claw 582 to move to the lowered position thereof. In Step S004, the engaging claw drive mechanism section 591 drives the engaging claw 592 to move to the lowered position thereof.

In Step S005, the tag memory reader/writer section 55 reads in the information written on the ID tag memory seal 100 attached to the logo label plate 654.

In Step S006, the information written on the ID tag memory seal 100 is the specific ID information of the manufacturer or not is determined.

If the outcome of the determination in Step S006 is YES, the process proceeds to Step S008 to end the loading process. If, on the other hand, the outcome of the determination in Step S006 is NO, the process proceeds to Step S007, where a warning to the user is displayed on the operation display panel 711. If the outcome of the determination is NO, it may simply mean that the ID tag memory 650 is unreadable. Then, the displayed warning may tell, for example, "The detected toner cartridge may not be a toner cartridge supplied by the manufacturer". With such a warning, the manufacturer of the printer 2 can have the user use the toner cartridge, recognizing that it is not a genuine toner cartridge.

Figure 7:
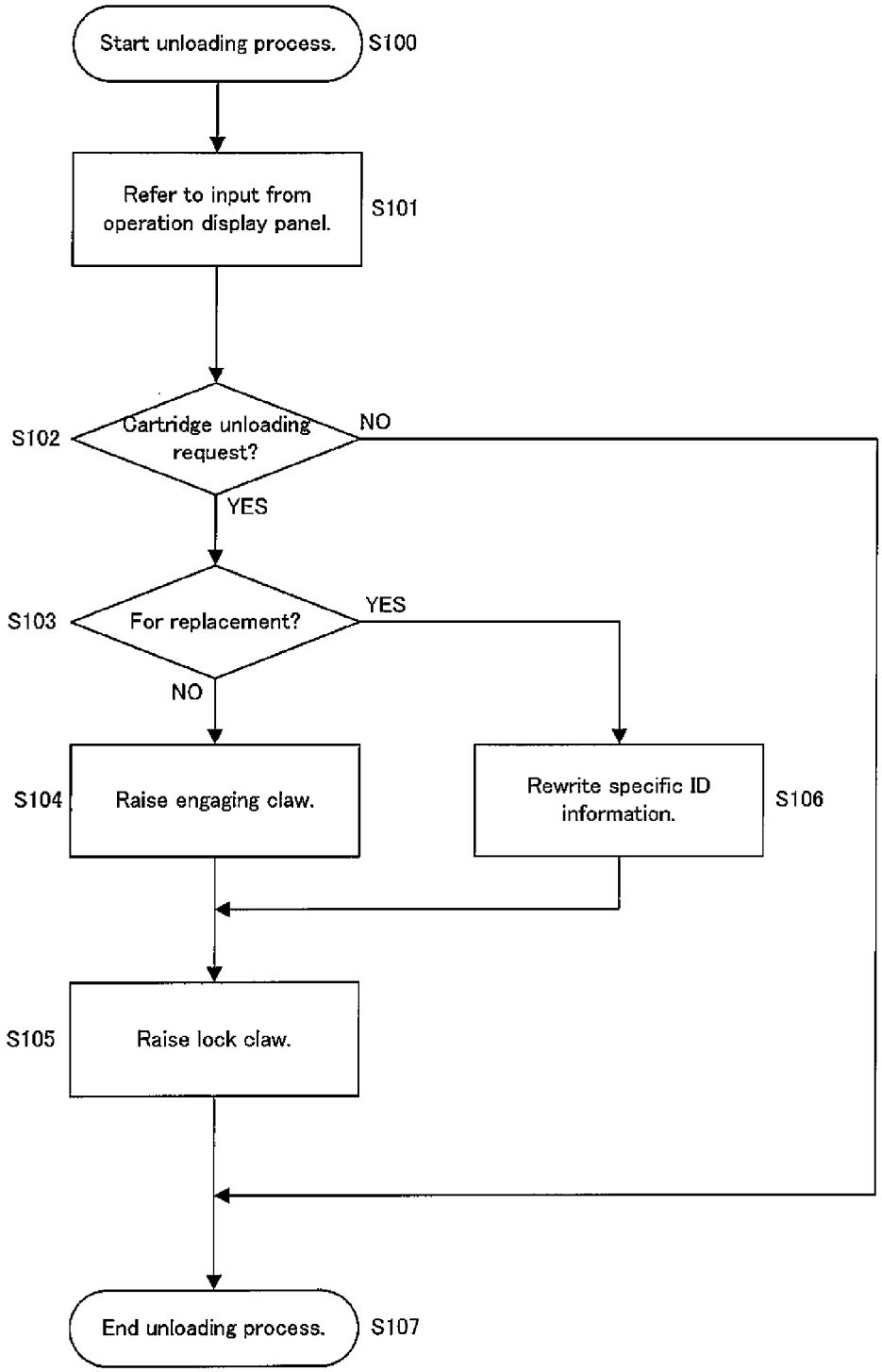
FIG. 7 is a flowchart of the process of unloading a toner cartridge of the embodiment of FIG. 3.

Now, how the process of unloading a toner cartridge 611 is controlled will be described below. FIG. 7 is a flowchart of the process of unloading a toner cartridge of this embodiment of the present invention.

Referring to FIG. 7, in Step S100, the process of unloading a toner cartridge 611 is started. Then, the process proceeds to Step S101 to refer to the user input at the operation display panel 711.

In Step S102, if the user inputs an unloading request on the operation display panel 711 or not is determined.

The process proceeds to Step S103 when the outcome of the determination in Step S102 is YES, whereas it proceeds to Step S107 to end the process when the outcome of the determination in Step S102 is NO.

In Step S103, the purpose of unloading the toner cartridge 611 is determined. In other words, the user is requested to input the purpose of unloading the toner cartridge 611 at the operation display panel 711. In Step S103, whether the purpose of unloading the toner cartridge 611 is for replacement or not is determined. The toner cartridge 611 may be unloaded so as to be used in some other printer 2 of the same type when the purpose of unloading the toner cartridge 611 not for replacement.

The process proceeds to Step S106 when the outcome of the determination in Step S103 is YES, whereas it proceeds to Step S104 when the outcome of the determination in Step S103 is NO.

In Step S106, a process of rewriting the specific ID information of the ID tag memory 650 of the ID tag memory seal 100 is executed. This rewriting process may be a process of making the specific ID information ineffective. In short, information telling that the toner cartridge 611 has already been used once needs to be provided when the ID tag memory 650 is read for the second time. If possible the rewriting process is preferably a one time rewriting process. After Step S106, the process proceeds to Step S105.

In Step S104, the engaging claw drive mechanism section 591 drives the engaging claw 592 to move to the raised position. In Step S105, the lock claw drive mechanism section 581 drives the lock claw 582 to move to the raised position.

The process of unloading the toner cartridge 611 ends in Step S107.

With the above-described arrangement, the TD tag memory seal attached to the logo label plate 654 is moved without fail after the first use of the toner cartridge 611 so that the user can determine if the toner cartridge is a refilled product or not at a glance by checking the status of the ID tag memory seal 100. Additionally, since the ID tag memory 650 is driven to move to a position where the tag memory reader/writer section 55 can no longer read it, the printer 2 can electrically determine if the consumable cartridge is refilled product or not.

Figure 8A:
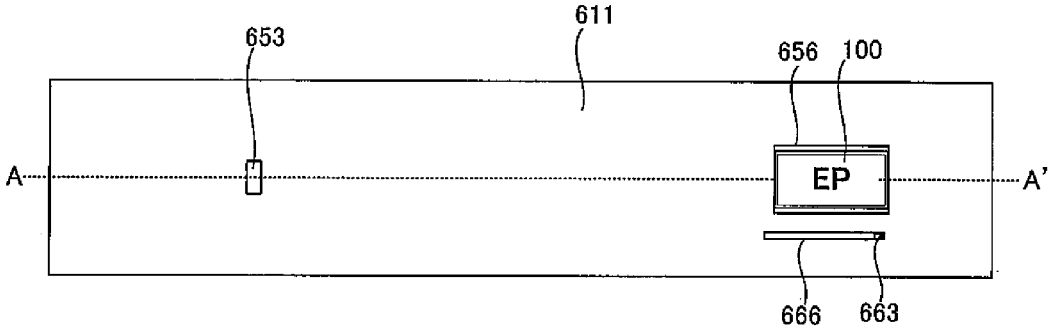
FIG. 8A is a schematic top view of another embodiment of consumable cartridge according to the present invention, which is also a toner cartridge.
Figure 8B:
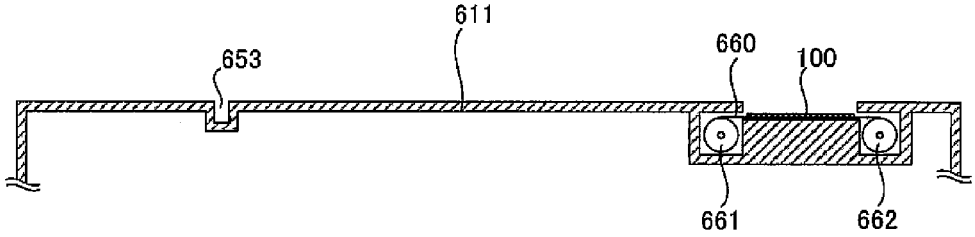
FIG. 8B is a part of a schematic cross-sectional view of the toner cartridge of the another embodiment of FIG. 8A taken along line A-A' in FIG. 8A.
Figure 9:
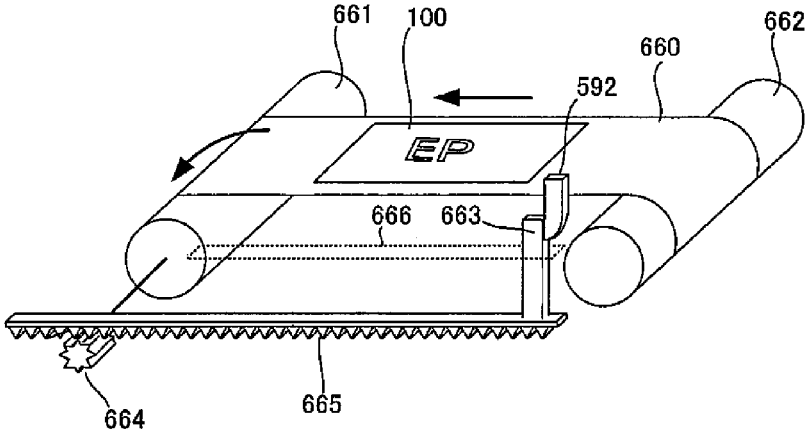
FIG. 9 is a schematic cross-sectional view of the drive mechanism for the ID tag memory seal 100 of the toner cartridge of the another embodiment of the present invention.

Now, the configuration of another embodiment of toner cartridge will be described below. FIGS. 8A and 8B schematically illustrate the another embodiment of toner cartridge according to the present invention. FIG. 8A is a schematic top view of the another embodiment of the toner cartridge and FIG. 8B is a part of a schematic cross-sectional view of the toner cartridge of the another embodiment taken along line A-A' in FIG. 8A. FIG. 9 is a schematic cross-sectional view of the drive mechanism section for the ID tag memory seal 100 of the another embodiment of toner cartridge of the present invention.

Referring now to FIGS. 8A through 9, 653 and 656 respectively denote a lock claw engaging recess and a label exposing aperture section and 660 and 661 respectively denote a logo label film and a take-up roll, while 662 and 663 respectively denote a feed roll and a rack interlocking lever and 664 and 665 respectively denote a pinion member and a rack member.

As shown in FIGS. 8A and 8B, the lock claw engaging recess 653 to be engaged with a lock claw that is controlled by the cartridge lock control section 58 is arranged at the front surface of the toner cartridge 611.

The label exposing aperture section 656 is also arranged at the front surface of the toner cartridge 611 and the feed roll 662 for feeding out logo label film 660 and the take-up roll 661 for taking up the fed out logo label film 660 are arranged at opposite sides of the label exposing aperture section 656.

The logo label film 660 has a region where an ID tag memory seal 100 is attached and the ID tag memory seal 100 on the logo label film 660 can be recognized through the label exposing aperture section 656 as shown in FIG. 8.

Now, the drive mechanism for the ID tag memory seal 100 of this embodiment will be described below. Like the preceding embodiment, this embodiment also has a cartridge lock control mechanism section 580 that includes a lock claw 582 that can be inserted into the lock claw engaging recess 653 and a lock claw drive mechanism section 581, which is typically an actuator for driving the lock claw 582 to move up and down.

This embodiment also has a logo label control mechanism section 590 that includes an engaging claw 592 that can be engaged with the rack interlocking lever 663 (which corresponds to the plate perpendicular piece 655 of the preceding embodiment) and an engaging claw drive mechanism section 591, which is typically an actuator for driving the engaging claw 592 to move up and down.

The take-up roll 661 and the pinion member 664 are secured to a common shaft so as to be driven together and the rack member 665 is to be engaged with the pinion member 664. With the above-described arrangement, as the rack interlocking lever 663 is drive to move leftward in FIGS. 8A and 8B by means of the engaging claw 592, the ID tag memory seal 100 attached to the logo label film 660 is driven to move and taken up by the take-up roll 661 until it is moved away from the label exposing aperture section 656 and the user can no longer see the logo label 121 of the ID tag memory seal 100. With this move, the ID tag memory 650 of the ID tag memory seal 100 is also shifted away from the reading position (not shown) of the tag memory reader/writer section 55. As a result, if the toner cartridge 611 is loaded once again in the printer 2, the printer 2 can no longer electrically recognize the ID tag memory 650. Additionally, the logo label film 660 may preferably be provided with an aluminum layer so that the logo label 121 is completely shielded by the aluminum layer of the label film. Then, the tag memory reader/writer section 55 reliably becomes unable to read the ID tag memory 650.

With the above-described arrangement, the ID tag memory seal 100 attached to the logo label plate 654 is moved after the first use of the toner cartridge 611 without fail so that the user can see the status of the ID tag memory seal 100 and clearly realize if the toner cartridge is a refilled product or not at a glance and, at the same time, the printer 2 can electrically determine if the consumable cartridge is a refilled product or not.

Figure 10A:
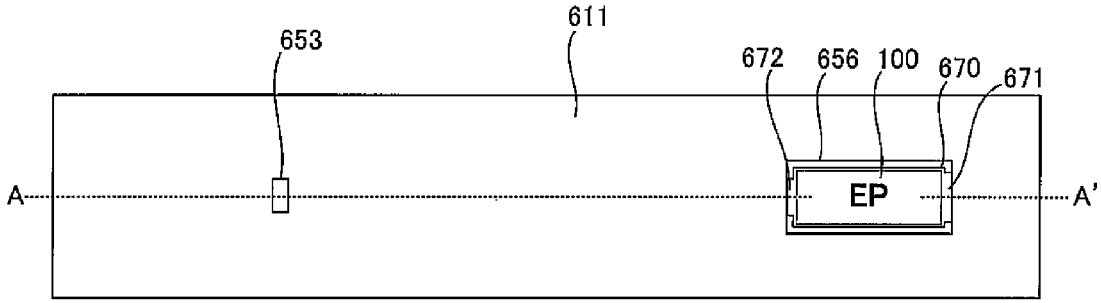
FIG. 10A is a schematic top view of the toner cartridge of still another embodiment of the present invention.
Figure 10B:
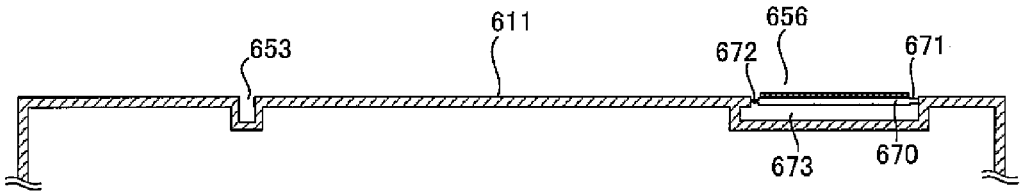
FIG. 10B is a part of a schematic cross-sectional view of the toner cartridge of the still another embodiment of the present invention taken along line A-A' in FIG. 10A.

Now, the configuration of still another embodiment of toner cartridge will be described below. FIGS. 10A and 10B schematically illustrate the still another embodiment of toner cartridge according to the present invention. FIG. 10A is a schematic top view of the still another embodiment of the toner cartridge and FIG. 10B is a part of a schematic cross-sectional view of the toner cartridge of the still another embodiment taken along line A-A' in FIG. 10A.

Referring to FIGS. 10A through 11, 670 denotes a logo label plate and 671 and 672 respectively denote a first rib and a second rib, while 673 and 595 respectively denote a fallen plate containing section and a logo label control mechanism section and 596 and 597 respectively denote a plunger and a hitting projection section.

As shown in FIGS. 10A and 10B, a lock claw engaging recess 653 to be engaged with a lock claw that is controlled by the cartridge lock control section 58 is arranged on the front surface of the toner cartridge 611.

Additionally, a label exposing aperture section 656 is arranged at the front surface of the toner cartridge 611 and a resin-made logo label plate 670 is arranged at the center of the label exposing aperture section 656. The logo label plate 670 is fastened to a peripheral section of the label exposing aperture section 656 by the first rib 671 and the second rib 672 at opposite sides so as to be integral with the label exposing aperture section 656. Note that the strength by which the first rib 671 fastens itself to the peripheral section is greater than the strength by which the second rib 672 fastens itself to the peripheral section. In other words, the second rib 672 is more fragile than the first rib 671.

The logo label plate 670 has a region where the ID tag memory seal 100 is attached to it and, as shown in FIGS. 10A and 10B, the user can recognize the ID tag memory seal 100 on the logo label film 660 through the label exposing aperture section 656.

Figure 11:
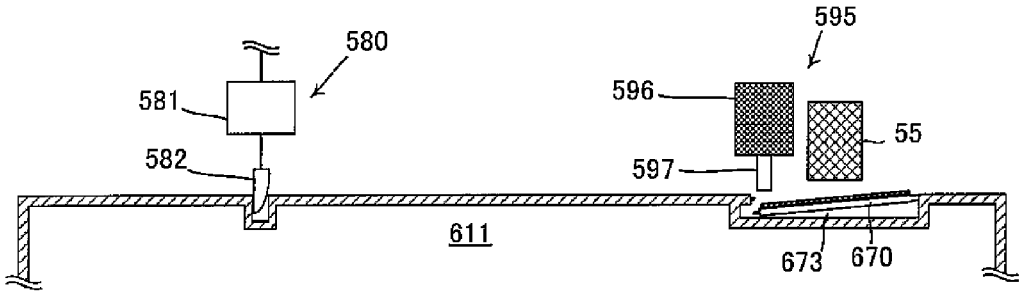
FIG. 11 is a schematic illustration of the toner cartridge of the still another embodiment of to the present invention loaded into a printer.

FIG. 11 illustrates how the toner cartridge is set in the loading position. Referring to FIG. 11, the tag memory reader/writer section 55, the cartridge lock control mechanism section 580 and the logo label control mechanism section 590 all belong to the printer 2. The lock claw drive mechanism 581 and the logo label control mechanism section 590 are controlled respectively by the cartridge lock control section 58 and the logo label control section 59. Note that the tag memory reader/writer section 55 in FIG. 11 is that of the ID tag memory 650 and that of the history tag memory 612 is not shown in FIG. 11.

The cartridge lock control mechanism section 580 includes the lock claw 582 that can be inserted into the lock claw engaging recess 658 and the lock claw drive mechanism section 581, which may typically be an actuator for driving the lock claw 582 to move up and down. The cartridge lock control mechanism section 580 is similar to those of the preceding embodiments. The lock claw 582 is driven to move by the lock claw drive mechanism section 581 to take either of two positions including a raised position and a lowered position.

The logo label control mechanism section 595 includes the hitting projection section 597 for hitting the logo label plate 679 at the cartridge loading position and a plunger 596 for applying drive force for hitting to the hitting projection section 597. FIG. 11 shows that the logo label plate 670 is hit by the hitting projection section 597 and the second rib 672 is destroyed.

Figure 12:
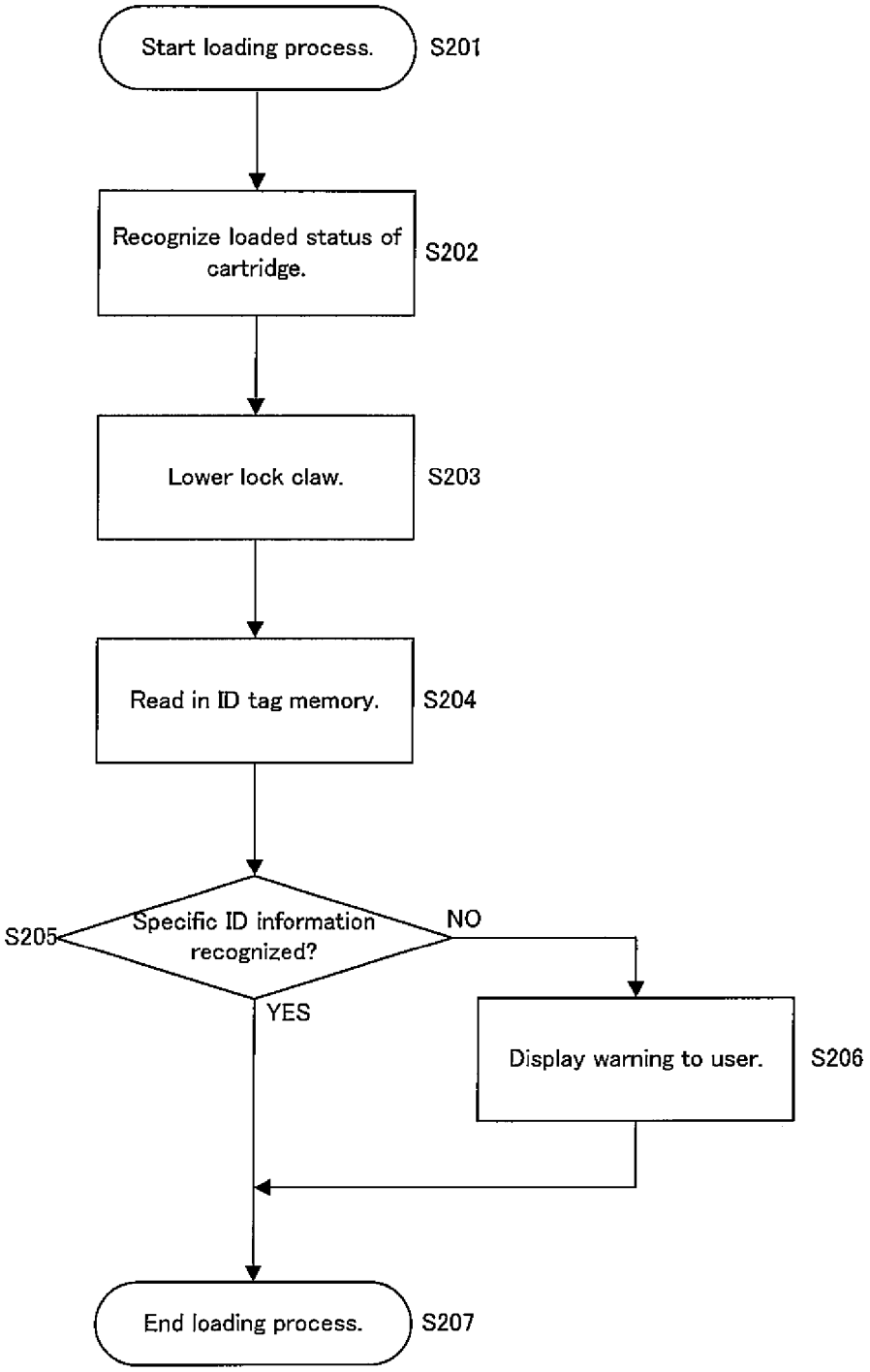
FIG. 12 is a flowchart of the process of loading the toner cartridge of the still another embodiment of the present invention.

Now, the control operation for loading and unloading the toner cartridge 611 of the still another embodiment having the above-described configuration will be described below. FIG. 12 is a flowchart of the process of loading the toner cartridge of the still more another embodiment of the present invention.

Firstly, in Step S201, the process of loading a toner cartridge 611 is started. Then, the process proceeds to Step S202, where a sensor (not shown) for sensing the completion of a loading process recognizes the loaded status of the toner cartridge 611. Then, in Step S203, the lock claw drive mechanism section 581 drives the lock claw 582 to move to the lowered position thereof.

In Step S204, the tag memory reader/writer section 55 reads in the information written on the ID tag memory seal 100 attached to the logo label plate 670.

In Step S205, the information written on the ID tag memory seal 100 is the specific ID information of the manufacturer or not is determined. If the outcome of the determination in Step S205 is YES, the process proceeds to Step S207 to end the loading process. If, on the other hand, the outcome of the determination in Step S205 is NO, the process proceeds to Step S206, where a warning to the user is displayed on the operation display panel 711. The displayed warning may tell, for example, "The detected toner cartridge may not be a toner cartridge supplied by the manufacturer. The user should be noted that, when the printer gets into a trouble as a result of using this toner cartridge, the cost of repairing the printer may be charged to the user". With such a warning, the manufacturer of the printer 2 can have the user use the toner cartridge, recognizing that it is not a genuine toner cartridge.

Figure 13:
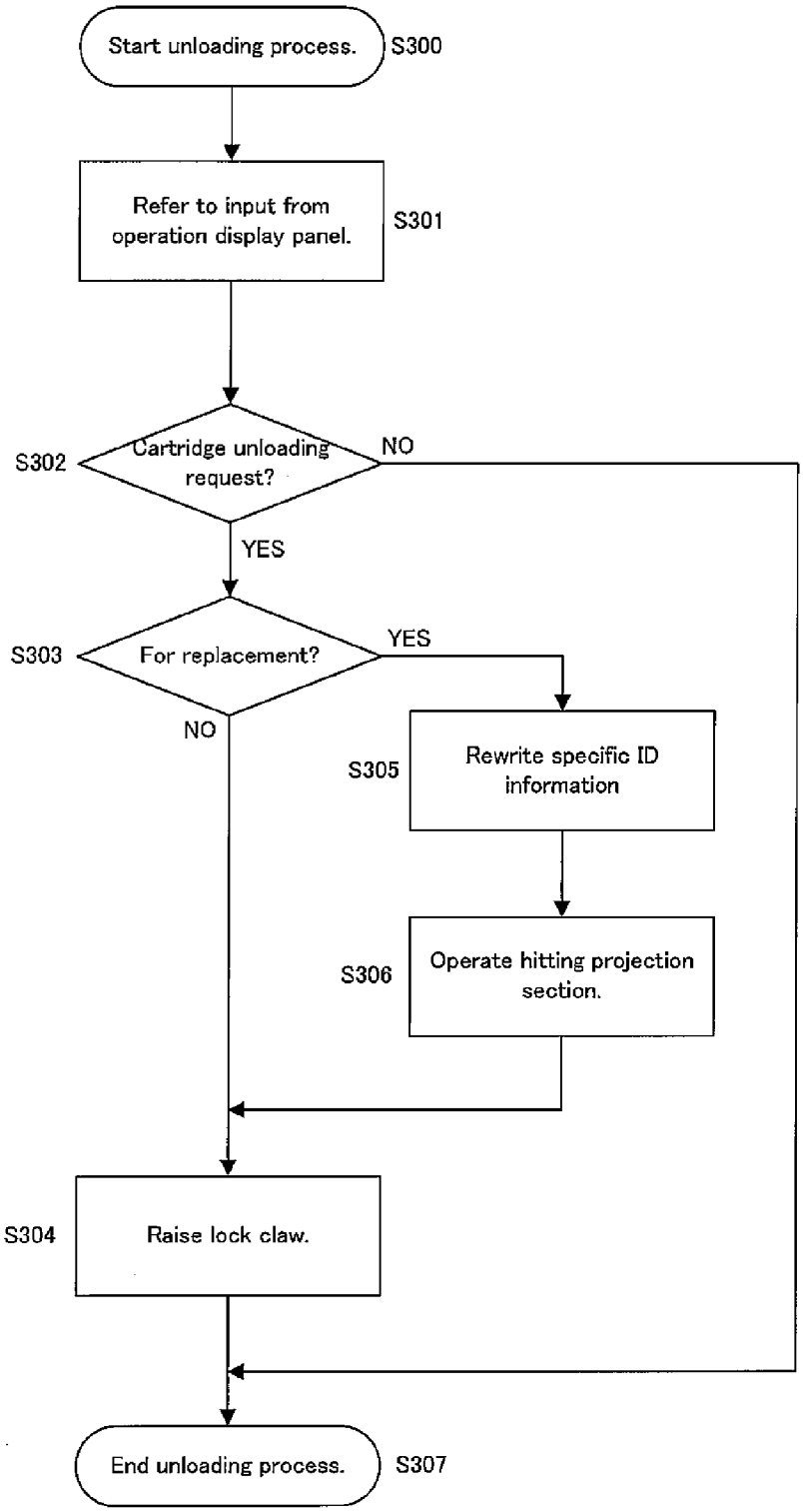
FIG. 13 is a flowchart of the process of unloading the toner cartridge of the still another embodiment of the present invention.

Now, how the process of unloading a toner cartridge 611 is controlled will be described below. FIG. 13 is a flowchart of the process of unloading a toner cartridge of this still another embodiment of the present invention.

Referring to FIG. 13, in Step S300, the process of unloading a toner cartridge 611 is started. Then, the process proceeds to Step S301 to refer to the user input at the operation display panel 711.

In Step S302, if the user inputs an unloading request on the operation display panel 711 or not is determined.

The process proceeds to Step S303 when the outcome of the determination in Step S302 is YES, whereas it proceeds to Step S307 to end the process when the outcome of the determination in Step S302 is NO.

In Step S303, the purpose of unloading the toner cartridge 611 is determined. In other words, the user is requested to input the purpose of unloading the toner cartridge 611 at the operation display panel 711. In Step 303, whether the purpose of unloading the toner cartridge 611 is for replacement or not is determined. The toner cartridge 611 may be unloaded so as to be used in some other printer 2 of the same type when the purpose of unloading the toner cartridge 611 not for replacement.

The process proceeds to Step S305 when the outcome of the determination in Step S303 is YES, whereas it proceeds to Step S304 when the outcome of the determination in Step S303 is NO.

In Step S305, a process of rewriting the specific ID information of the ID tag memory 650 in the ID tag memory seal 100 is executed. This rewriting process may be a process of making the specific ID information ineffective. In short, information telling that the toner cartridge 611 has already been used once needs to be provided when the ID tag memory 650 is read for the second time. If possible, the rewriting process is preferably a one time rewriting process.

In the next step, or Step S306, the plunger 596 is driven to apply drive force to the hitting projection section 597 and destroy the second rib 672 of the logo label plate 670.

In Step S304, the lock claw drive mechanism section 581 drives the lock claw 582 to move to the raised position. The process of unloading the toner cartridge 611 ends in Step S307.

With the above-described arrangement, the ID tag memory seal 100 attached to the logo label plate 670 is moved without fail after the first use of the toner cartridge 611 so that the user can determine if the toner cartridge is a refilled product or not at a glance by checking the status of the ID tag memory seal 100. Additionally, the printer 2 can electrically determine if the consumable cartridge is refilled product or not.

Figure 14A:
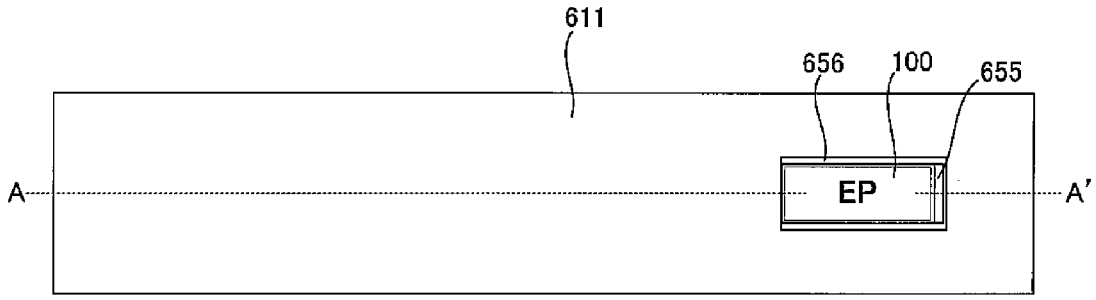
FIG. 14A is a schematic top view of still more another embodiment of consumable cartridge according to the present invention, which is also a toner cartridge.
Figure 14B:
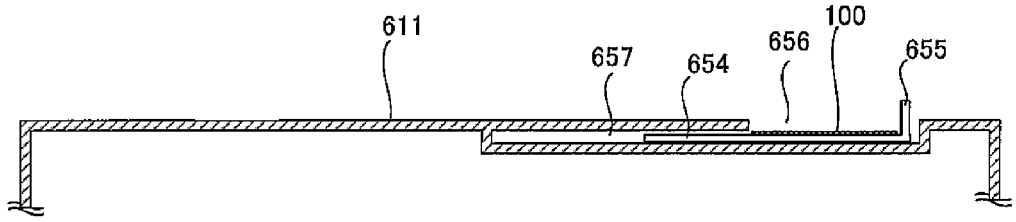
FIG. 14B is a part of a schematic cross-sectional view of the toner cartridge of the still more another embodiment of the present invention taken along line A-A' in FIG. 14A.

Now, the configuration of still more another embodiment of toner cartridge will be described below. FIGS. 14A and 14B schematically illustrate the still more another embodiment of toner cartridge according to the present invention. FIG. 14A is a schematic top view of the still more another embodiment of the toner cartridge and FIG. 14B is a part of a schematic cross-sectional view of the toner cartridge taken along line A-A' in FIG. 14A.

The configuration of the toner cartridge of this embodiment is a simplified version of the first embodiment of toner cartridge and that of printer and hence a reduced cost version thereof. While the first embodiment employs actuators for the cartridge lock control mechanism and the engaging claw drive mechanism for the purpose of driving the lock claw and the engaging claw to move up and down, any cartridge lock control mechanism is omitted from the embodiment and the engaging claw drive mechanism is realized not by an electrically driven actuator but by elastic force.

In FIGS. 14A and 14B, 654 denotes a logo label plate and 655 denotes a plate perpendicular piece, while 656 denotes a label exposing aperture section and 657 denotes a plate containing section.

The label exposing aperture section 656 is arranged at the front surface of the toner cartridge 611 and the plate containing section 657 is provided with a cavity section that communicates with the label exposing aperture section 656. The logo label plate 654 is contained in the plate containing section 657 so as to be movable to left and right in FIGS. 14A and 14B.

The logo label plate 654 has a surface region where an ID tag memory seal 100 is attached and a plate perpendicular piece 655 that is a projecting piece projecting perpendicularly relative to the surface region. As the plate perpendicular piece 655 is moved in the leftward direction in FIGS. 14A and 14B, the ID tag memory seal 100 attached to the logo label plate 654 is moved from the label exposing aperture section 656 into the plate containing section 657 until the user can no longer see the logo label 121 of the ID tag memory seal 100.

Figure 15A:
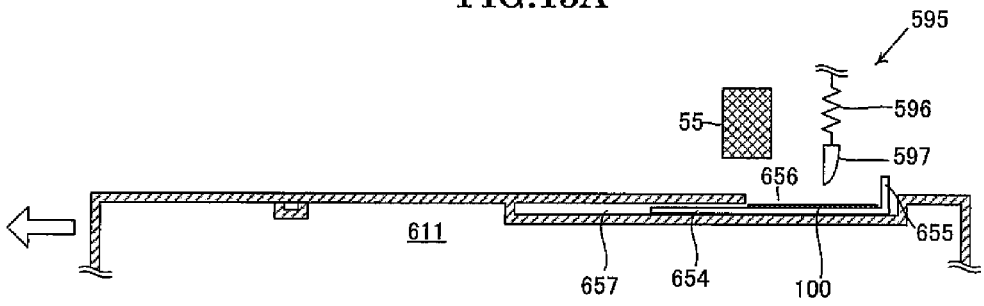
FIG. 15A is a schematic illustration of the toner cartridge of the still more another embodiment of the present invention, showing how it appears immediately before being set in the loading position thereof.
Figure 15B:
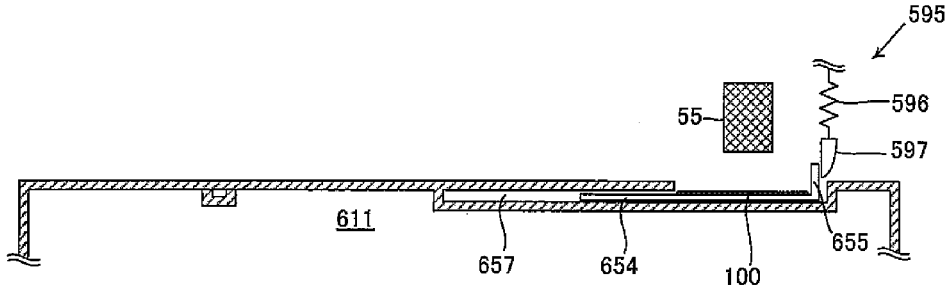
FIG. 15B is a schematic illustration of the toner cartridge of the still more another embodiment of the present invention, showing how it appears when being set in the loading position thereof.
Figure 15C:
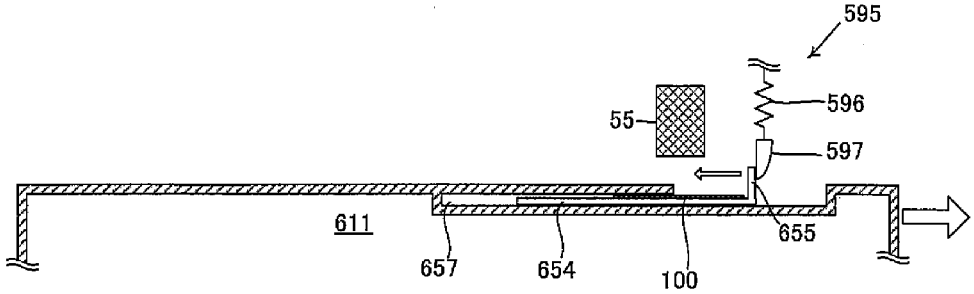
FIG. 15C is a schematic illustration of the toner cartridge of the still more another embodiment of the present invention, showing how it appears when being unloaded for replacement.

Now, the operation of loading the toner cartridge 611 having the above-described configuration into the printer 2 will be described below. FIGS. 15A through 15C schematically illustrate how a toner cartridge of this embodiment is loaded in the printer. FIG. 15A is a schematic illustration of the toner cartridge that shows how it appears immediately before being set in the loading position thereof. FIG. 15B is a schematic illustration of the toner cartridge that shows how it appears when set in the loading position thereof. FIG. 15C is a schematic illustration of the toner cartridge that shows how it appears when being unloaded for replacement. Assume here that the toner cartridge 611 is pushed from right to left for a loading operation and drawn out from left to right for an unloading operation in FIGS. 15A through 15C.

Referring to FIGS. 15A through 15C, 595 denotes a logo label control mechanism section and 596 denotes an elastic member, while 597 denotes an engaging claw.

Both the tag memory reader/writer section 55 and the logo label control mechanism section 595 belong to the printer 2. Since a mechanism for locking the toner cartridge is omitted from this embodiment, the cartridge lock control section 58 of the printer 2 can also be omitted.

Since the logo label control mechanism section 595 is driven to operate by the elastic section 596, the logo label control section 59 of the printer 2 can also be omitted. Note that the tag memory reader/writer section 55 in FIGS. 15A through 15C is that of the ID tag memory 650 and that of the history tag memory 612 is not shown in FIGS. 15A through 15C.

The logo label control mechanism section 959 includes an engaging claw 597 that can be engaged with the plate perpendicular piece 655 and the elastic member 596 for applying vertical elastic force to the engaging claw 597.

FIG. 15A is a schematic illustration of the toner cartridge 611 that shows how it appears immediately before being set in the loading position thereof. When the user pushes the toner cartridge leftward right away, the engaging claw 597 moves up and down so as to ride over the plate perpendicular piece 655 due to the effect of the elastic member 596. Thus, the user can set the toner cartridge 611 in the loading position of the printer 2, feeling an appropriate sensation of click.

FIG. 15B is a schematic illustration of the toner cartridge 611 that shows how it appears when set in the loading position thereof. In this state, the engaging claw 597 is engaged with the plate perpendicular piece 655 as shown in FIG. 15B. Additionally, in the state of FIG. 15B, the tag memory reader/writer section 55 disposed above the top surface of the ID tag memory seal 100 that is attached to the logo label plate 654 can read information from and write information in the ID tag memory 650.

FIG. 15C is a schematic illustration of the toner cartridge 611 that shows how it appears when being unloaded for replacement. In other words, it shows the toner cartridge 611 immediately after leaving the loading position. In this state, since the engaging claw 597 is held in engagement with the plate perpendicular piece 655 as shown, the logo label plate 654 can be moved leftward in FIG. 15C to move the ID tag memory seal 100 attached to the logo label plate 654 from the label exposing aperture section 656 into the plate containing section 657 so as to make the logo label 121 on the ID tag memory seal 100 no longer visible to the user. As a result of this move, the ID tag memory 650 of the ID tag memory seal 100 is shifted away from the reading position of the tag memory reader/writer section 55. The label exposing aperture section 657 may preferably be provided on the inner surface with an aluminum layer to make the tag memory reader/writer section 55 unable to recognize the ID tag memory 650. As a result, if the toner cartridge 611 is loaded once again in the printer 2, the printer 2 can no longer electrically recognize the ID tag memory 650.

While this embodiment is so arranged that the ID tag memory 650 is moved without fail, once the toner cartridge 611 is removed from the printer 2 regardless if the user has an intention of ending the use of the toner cartridge 611 or not. However, such an arrangement that the ID tag memory 650 is moved without fail once the toner cartridge 611 is removed from the printer 2 regardless if the user has an intention of ending the use of the toner cartridge 611 or not can be realized by means of an embodiment having a take-up roll for taking up the logo label film as shown in FIGS. 8A through 9.

With the above-described arrangement, the ID tag memory seal 100 attached to the logo label plate 654 or the logo label film 660 is moved without fail after the first use of the toner cartridge 611 so that the user can determine if the toner cartridge is a refilled product or not at a glance by checking the status of the ID tag memory seal 100. Additionally, the printer 2 can electrically determine if the consumable cartridge is refilled product or not.

Figure 16A:
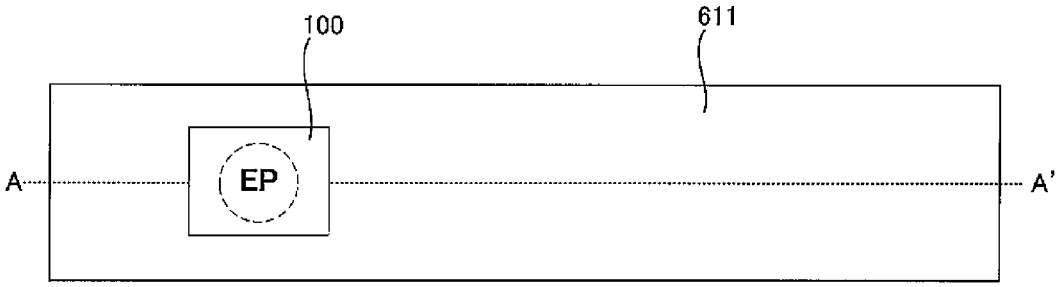
FIG. 16A is a schematic top view of a further embodiment of consumable cartridge according to the present invention, which is also a toner cartridge.
Figure 16B:
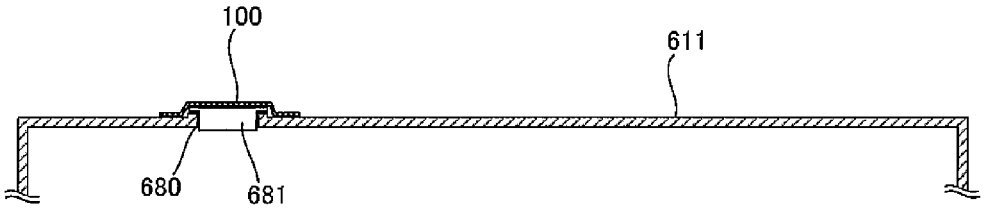
FIG. 16B is a part of a schematic cross-sectional view of the toner cartridge of the further embodiment of the present invention taken along line A-A' in FIG. 14A.

Now, the configuration of a further embodiment of toner cartridge will be described below. FIGS. 16A and 16B schematically illustrate the further embodiment of toner cartridge according to the present invention. FIG. 16A is a schematic top view of the further embodiment of the toner cartridge and FIG. 16B is a part of a schematic cross-sectional view of the toner cartridge taken along line A-A' in FIG. 16A.

The configuration of the toner cartridge and that of the printer of this embodiment differ greater from those of the toner cartridges and those of the printers of the preceding embodiments in terms of the position where the an ID tag memory seal 100 is attached. While the toner cartridge is provided with a predetermined movable part and the toner cartridge is attached to the movable part in the preceding embodiments described above, the ID tag memory seal 100 is attached to a position that is inevitably moved in the process of regenerating the toner cartridge in this embodiment.

Referring FIGS. 16A and 16B, 680 denotes a sealable toner inlet port and 681 denotes a cap section for closing the toner inlet port 680. As shown in FIGS. 16A and 16B, the ID tag memory seal 100 is attached to the cap section 681 for closing the sealable toner inlet port 680 for sealably putting toner into the toner cartridge 611 so as to cover the cap section 681.

Figure 17:
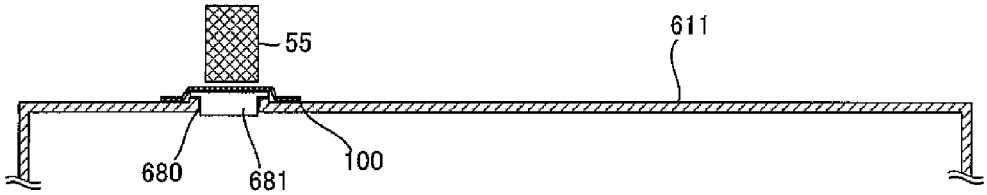
FIG. 17 is a schematic illustration of the toner cartridge of the further embodiment of the present invention when being loaded into a printer.
Figure 18:
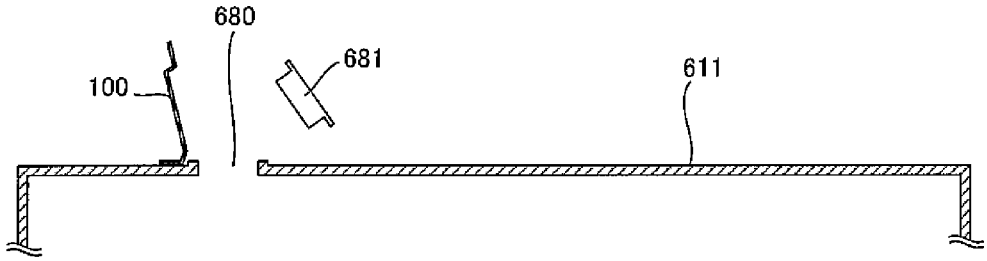
FIG. 18 is a schematic illustration of the toner cartridge of the further embodiment of the present invention when being refilled with toner.

FIG. 17 is a schematic illustration of the toner cartridge of the further embodiment of the present invention when being loaded into a printer and FIG. 18 is a schematic illustration of the toner cartridge of the further embodiment of the present invention when being refilled with toner.

In this embodiment again, the tag memory reader/writer section 55 that belongs to the printer 2 is arranged at a position where it can read information from and write information in the ID tag memory 650 of the ID tag memory seal 100 attached to the cap section 681 as shown in FIG. 17. With this arrangement, when the ID tag memory seal 100 is read out by the tag memory reader/writer section 55 but the specific ID of the manufacturer of the printer 2 cannot be recognized, a warning is displayed on the operation display panel 711. This time, the displayed warning may tell, for example, "The detected toner cartridge may not be a toner cartridge supplied by the manufacturer. The user should be noted that, when the printer gets into a trouble as a result of using this toner cartridge, the cost of repairing the printer may be charged to the user". With such a warning, the manufacturer of the printer 2 can have the user use the toner cartridge, recognizing that it is not a genuine toner cartridge.

When the toner cartridge 611 of this embodiment having the above-described configuration is to be regenerated by filling it with toner and sealing it, the ID tag memory seal 100 attached to the cap section 681 needs to be peeled off to expose the sealable toner inlet port 680 as shown in FIG. 18. In other words, the ID tag memory seal 100 is moved after the first use of the toner cartridge 611 without fail so that the user can see the status of the ID tag memory seal 100 and clearly realize if the toner cartridge is a refilled product or not at a glance and, at the same time, the printer 2 can electrically determine if the consumable cartridge is a refilled product or not.

While a consumable cartridge of a printer according to the present invention is described in terms of a toner cartridge above, the present invention is applicable to any consumable cartridge that is filled with a recording medium for an image forming apparatus. Therefore, the concept of the present invention is applicable to an ink cartridge that is a consumable of an ink-jet type printer.

Additionally, while an image forming apparatus according to the present invention is described in terms of a printer above, the present invention is generally applicable to any relationship between an image forming apparatus and a consumable necessary for the image forming apparatus. More specifically, the present invention is applicable to image forming apparatus of other types such as electrophotographic type copying machines, electrophotographic type facsimile machines, electrophotographic type multifunction devices, ink-jet type printers, ink-jet type facsimile machines and ink-jet type multifunction devices.

Still additionally, while the ID tag memory 650 is realized by using an RFID chip in the above description, the ID tag memory 650 is only required to have a functional feature of electrically indicating that the toner cartridge 611 is supplied by the manufacturer of the image forming apparatus (printer 2). Therefore, the ID tag memory 650 may alternatively be formed as a resistor having a predetermined resistance value so that the toner cartridge 2 can be determined to have been supplied by the manufacturer of the printer 2 when electricity is applied to the ID tag memory 650 and the predetermined resistance value can be detected at the printer 2.

While the present invention is described above by various embodiments, the present invention also encompasses the embodiments that are formed by arbitrarily combining some of the components of the above-described embodiments.

What is claimed is:

1. A consumable cartridge for supplying a consumable to be used in the image forming process of an image forming apparatus to the image forming apparatus, the consumable cartridge comprising:

a memory identification section arranged at a predetermined position and including a memory electrically indicating that the consumable cartridge is supplied by the manufacturer of the image forming apparatus and a label section arranged on the surface of the memory;

the memory identification section being so arranged as to be movable from the predetermined position to become unreadable to a memory reader section of the image forming apparatus when the image forming apparatus acknowledges a request for removing the consumable cartridge.

2. The consumable cartridge according to claim 1, wherein the label section is a logo label section for causing the user to visually recognize that the consumable cartridge is supplied by the manufacturer of the image forming apparatus.

3. The consumable cartridge according to claim 1, wherein the memory identification section is so arranged as to be interlocked with the consumable cartridge being removed from the image forming apparatus and become movable.

4. The consumable cartridge according to claim 1, wherein the memory identification section is a plate that can slide.

5. The consumable cartridge according to claim 1, wherein the memory identification section is a film that can be taken up.

6. The consumable cartridge according to claim 1, wherein the memory identification section is arranged on a cap section for sealing the consumable filling mouth of the consumable cartridge to be used when the consumable cartridge is filled with consumable.

7. An image forming apparatus to be loaded with a consumable cartridge having a memory identification section arranged at a predetermined position and including a memory electrically indicating that the consumable cartridge is supplied by the manufacturer of the image forming apparatus and a label section arranged on the surface of the memory, the image forming apparatus comprising:

a memory reader/writer section for reading the information stored and/or writing the information on the memory;

a removal request determining section for determining if a request for removing the consumable cartridge is made or not; and a drive mechanism for driving the memory identification section to move when it is determined that a request for removing the consumable cartridge is made.

8. The image forming apparatus according to claim 7, wherein the memory reader/writer section rewrites the information stored in the memory when the removable request determining section determines that a request for removing the consumable cartridge is made.

9. An image forming apparatus to be loaded with a consumable cartridge having a memory identification section arranged at a predetermined position and including a memory electrically indicating that the consumable cartridge is supplied by the manufacturer of the image forming apparatus and a label section arranged on the surface of the memory, the image forming apparatus comprising:

a memory reader/writer section for reading the information stored and/or writing the information on the memory; and a drive mechanism for interlocking the consumable cartridge being removed from the image forming apparatus with and driving the memory identification section to move.

* * * * *